US007931004B2

(12) United States Patent
Koyama et al.

(10) Patent No.: US 7,931,004 B2
(45) Date of Patent: Apr. 26, 2011

(54) OIL SENSOR PLACEMENT STRUCTURE IN ENGINE

(75) Inventors: Yoshiaki Koyama, Saitama (JP); Hideo Ueshima, Saitama (JP); Yusuke Endo, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 204 days.

(21) Appl. No.: 12/314,331

(22) PCT Filed: Apr. 11, 2007

(86) PCT No.: PCT/JP2007/057984

§ 371 (c)(1),
(2), (4) Date: Dec. 8, 2008

(87) PCT Pub. No.: WO2007/145017

PCT Pub. Date: Dec. 21, 2007

(65) Prior Publication Data

US 2010/0059011 A1 Mar. 11, 2010

(30) Foreign Application Priority Data

Jun. 15, 2006 (JP) ..... 2006-166518

(51) Int. Cl.
*F01M 11/10* (2006.01)
*F02B 75/06* (2006.01)

(52) U.S. Cl. ..... 123/196 S; 123/195 C; 123/198 E; 123/196 R; 123/192.2; 340/450.3; 73/290 R

(58) Field of Classification Search ..... 123/192.2, 123/192.1, 195 C, 196 R, 196 S, 198 DA, 123/198 E; 73/53.05, 290 R, 295, 304 R
See application file for complete search history.

(56) References Cited

U.S. PATENT DOCUMENTS

| | | | | |
|---|---|---|---|---|
| 4,245,595 | A * | 1/1981 | Abe et al. | 123/195 C |
| 4,256,069 | A * | 3/1981 | Masuda et al. | 123/196 S |
| 4,410,885 | A * | 10/1983 | Stenstrom | 340/604 |
| 4,745,895 | A * | 5/1988 | Seilenbinder et al. | 123/196 S |
| 5,435,170 | A * | 7/1995 | Voelker et al. | 73/53.05 |
| 5,687,687 | A * | 11/1997 | Trueblood et al. | 123/196 S |
| 7,263,964 | B2 * | 9/2007 | Yamane et al. | 123/196 S |
| 7,387,101 | B2 * | 6/2008 | Fujiki et al. | 123/195 C |
| 7,498,932 | B1 * | 3/2009 | Steffen | 340/450.3 |
| 2003/0041659 | A1 * | 3/2003 | Marszalek et al. | 73/119 R |
| 2005/0092283 | A1 * | 5/2005 | Eguchi et al. | 123/196 M |
| 2007/0056549 | A1 * | 3/2007 | Fujiki et al. | 123/195 C |

* cited by examiner

*Primary Examiner* — Michael Cuff
*Assistant Examiner* — Hung Q Nguyen
(74) *Attorney, Agent, or Firm* — Arent Fox LLP

(57) ABSTRACT

In an engine, an oil level sensor (47) provided in a bottom part of an oil pan (15) storing engine oil so as to stand vertically upright is placed between a mutually parallel pair of balancer shafts (27, 28) housed in a balancer housing (21) provided between a lower face of a cylinder block and the oil pan (15). This not only enables the oil level sensor (47) to be placed compactly by utilizing effectively dead space formed between the pair of balancer shafts (27, 28), but also enables agitation of engine oil to be suppressed by the pair of balancer shafts (27, 28) and any degradation in detection precision due to engine oil splashing over the oil level sensor (47) to be prevented.

9 Claims, 9 Drawing Sheets

OIL SENSOR PLACEMENT STRUCTURE IN ENGINE

CROSS-REFERENCE TO RELATED APPLICATION

This application is a National Stage entry of International Application No. PCT/JP2007/057984 filed Apr. 11, 2007. The disclosure of the prior application is hereby incorporated in its entirety by reference.

TECHNICAL FIELD

The present invention relates to an oil sensor placement structure in an engine that includes a balancer housing for housing a mutually parallel pair of balancer shafts between a lower face of a cylinder block and an oil pan storing engine oil.

BACKGROUND ART

An arrangement in which, in order to determine the timing of changing engine oil of an automobile engine, an oil deterioration sensor for detecting the degree of deterioration of engine oil based on the pH value is provided in a bottom part of an oil pan is known from Patent Publication 1 below. This oil deterioration sensor includes a sensing part housing a sensing element in the interior and a mounting part supporting the sensing part, and the mounting part is fixed to the bottom part of the oil pan by inserting the sensing part upwardly from an opening formed in the bottom part of the oil pan.

Furthermore, an arrangement in which, in order to suppress disturbance of the liquid surface of engine oil stored in the interior of an engine oil pan, a baffle plate is provided above the engine oil is known from Patent Publication 2 below.

Patent Publication 1: Japanese Patent Application Laid-open No. 2003-83935

Patent Publication 2: Japanese Patent Application Laid-open No. 11-30115

DISCLOSURE OF INVENTION

Problems to be Solved by the Invention

The conventional oil deterioration sensor is formed from the sensing part, which is housed within the oil pan, and the mounting part, which is exposed on the outside of the oil pan; an oil hole for engine oil to enter and exit is formed in the vicinity of a lower end part of the sensing part, and a breather hole for air to enter and exit is formed in the vicinity of an upper end part of the sensing part. Because of this, when engine oil within the oil pan is disturbed and the splashes thus produced enter the sensing part via the breather hole, there is a possibility that the liquid level of the engine oil within the sensing part will change and affect the detection precision.

In order to prevent the engine oil from being disturbed, placing a baffle plate within the oil pan is effective, but providing a baffle plate gives rise to the problem of an increase in the number of components. Furthermore, when an exhaust pipe extending forward from a cylinder head of a transversely mounted engine is guided to the rear of a vehicle body by bending the exhaust pipe downward and rearward and passing it beneath the oil pan, it is necessary to guarantee a minimum ground clearance for the exhaust pipe by placing the exhaust pipe within an upward recess formed in the bottom part of the oil pan. When a balancer system is placed within the oil pan, if the recess for the exhaust pipe to pass through is formed in the oil pan, there is a possibility that due to the recess it will become difficult to guarantee a space for placing the oil sensor within the oil pan.

The present invention has been accomplished in the light of the above-mentioned circumstances, and it is an object thereof to place an oil sensor by utilizing dead space within an oil pan effectively while guaranteeing the detection precision of the oil sensor.

Means for Solving the Problems

In order to attain the above object, according to a first aspect of the present invention, there is proposed an oil sensor placement structure in an engine, the engine comprising a balancer housing for housing a mutually parallel pair of balancer shafts between a lower face of a cylinder block and an oil pan storing engine oil, the structure being characterized in that an oil sensor provided in a bottom part of the oil pan so as to stand vertically upright is placed between the pair of balancer shafts.

According to a second aspect of the present invention, there is proposed an oil sensor placement structure in an engine, the engine comprising a balancer housing for housing a mutually parallel pair of balancer shafts between a lower face of a cylinder block and an oil pan storing engine oil, the structure being characterized in that an oil sensor provided in a bottom part of the oil pan so as to stand vertically upright is placed so as to project into the interior of the balancer housing.

According to a third aspect of the present invention, in addition to the first or second aspect, an exhaust gas passage through which exhaust gas flows is placed beneath the oil pan, and the oil sensor is placed at a position where the oil sensor does not overlap with the exhaust gas passage when viewed vertically.

According to a fourth aspect of the present invention, in addition to the first or second aspect, a bottom part of the oil pan comprises a shallow bottom part and a deep bottom part having different depths, the exhaust gas passage through which exhaust gas flows is placed beneath the shallow bottom part, and the oil sensor is placed above the deep bottom part.

According to a fifth aspect of the present invention, in addition to any one of the first to fourth aspects, the oil sensor comprises a cover member covering a sensing element, and a breather hole formed in the vicinity of the upper end of the cover member is covered by a shielding part provided on the balancer housing.

According to a sixth aspect of the present invention, in addition to the fifth aspect, the shielding part surrounds at least an upper half of a portion of the oil sensor exposed within the oil pan.

According to a seventh aspect of the present invention, in addition to the fifth or sixth aspect, the shielding part is formed as a separate body from the balancer housing and is mounted on the balancer housing.

According to an eighth aspect of the present invention, in addition to any one of the fifth to seventh aspects, an air vent hole providing communication between the interior and exterior of the shielding part is formed at a position of the shielding part that is higher than the breather hole.

According to a ninth aspect of the present invention, in addition to any one of the fifth to seventh aspects, an air vent hole providing communication between the interior and exterior of the shielding part is formed at a position of the shielding part that does not face the opening direction of the breather hole.

An exhaust pipe 18 of an embodiment corresponds to the exhaust gas passage of the present invention, a driven balancer shaft 27 and a follower balancer shaft 28 of the embodiment correspond to the balancer shaft of the present invention, and an oil level sensor 47 of the embodiment corresponds to the oil sensor of the present invention.

EFFECTS OF THE INVENTION

In accordance with a first aspect of the present invention, since the oil sensor, which is provided in the bottom part of the oil pan storing engine oil so as to stand vertically upright, is placed between the pair of balancer shafts, which are housed within the balancer housing so as to be parallel to each other, not only can the oil sensor be placed compactly by utilizing effectively the dead space formed between the pair of balancer shafts, but it is also possible to make the pair of balancer shafts exhibit the function of a baffle plate for suppressing agitation of the engine oil, thereby preventing engine oil from splashing over the oil sensor and degrading the detection precision.

Furthermore, in accordance with the second aspect of the present invention, since the oil sensor, which is provided in the bottom part of the oil pan storing engine oil so as to stand vertically upright, is placed within the balancer housing so as to project therefrom, not only can the oil sensor be placed compactly by utilizing effectively the dead space formed in the interior of the balancer housing, but it is also possible to make the balancer housing exhibit the function of a baffle plate for suppressing agitation of the oil liquid surface, thereby preventing engine oil from splashing over the oil sensor and degrading the detection precision.

Moreover, in accordance with the third aspect of the present invention, since the oil sensor and the exhaust gas passage provided beneath the oil pan are placed at positions where they do not overlap each other when viewed from the vertical direction, it is possible to guarantee a distance between the oil sensor and the exhaust gas passage, which attains a high temperature, thus preventing degradation of the detection precision of the oil sensor due to heat.

Furthermore, in accordance with the fourth aspect of the present invention, among the shallow bottom part and the deep bottom part of the bottom part of the oil pan, the exhaust gas passage is placed beneath the shallow bottom part, the oil sensor is placed above the deep bottom part, and it is therefore possible to place the oil sensor by utilizing a space above the deep bottom part even if it is difficult to guarantee a space for placing the oil sensor above the shallow bottom part.

Moreover, in accordance with the fifth aspect of the present invention, the breather hole, which is formed in the vicinity of the upper end of the cover member covering the sensing element of the oil sensor, is covered with the shielding part provided on the balancer housing, and it is therefore possible by means of the shielding part to suppress the entrance of splashes of engine oil generated within the oil pan into the sensing part via the breather hole of the cover member, thus further enhancing the detection precision of the oil sensor.

Furthermore, in accordance with the sixth aspect of the present invention, of a portion of the oil sensor that is exposed within the oil pan, at least an upper half is surrounded by the shielding part, and it is therefore possible to reliably prevent splashes of engine oil from entering via the breather hole formed in the vicinity of the upper end of the cover member of the oil sensor.

Moreover, in accordance with the seventh aspect of the present invention, the shielding part is formed separately from the balancer housing and mounted on the balancer housing, and it is therefore easy to mold the balancer housing compared with a case in which the shielding part is molded integrally with the balancer housing, thus enhancing the degree of freedom in design of the shielding part.

Furthermore, in accordance with the eighth aspect of the present invention, the air vent hole, which provides communication between the interior and the exterior of the shielding part, is formed at a position of the shielding part that is higher than the breather hole, and it is therefore possible to keep the internal pressure of the shielding part constant, thus guaranteeing the detection precision of the oil sensor.

Moreover, in accordance with the ninth aspect of the present invention, the air vent hole, which provides communication between the interior and the exterior of the shielding part, is formed at a position of the shielding part that does not face the opening direction of the breather hole, and it is therefore possible to increase the degree of freedom in design of the position of the air vent hole and thus enhance the oil shielding effect while guaranteeing the detection precision of the oil sensor by keeping the internal pressure of the shielding part constant.

EXPLANATION OF REFERENCE NUMERALS AND SYMBOLS

Figure 1:
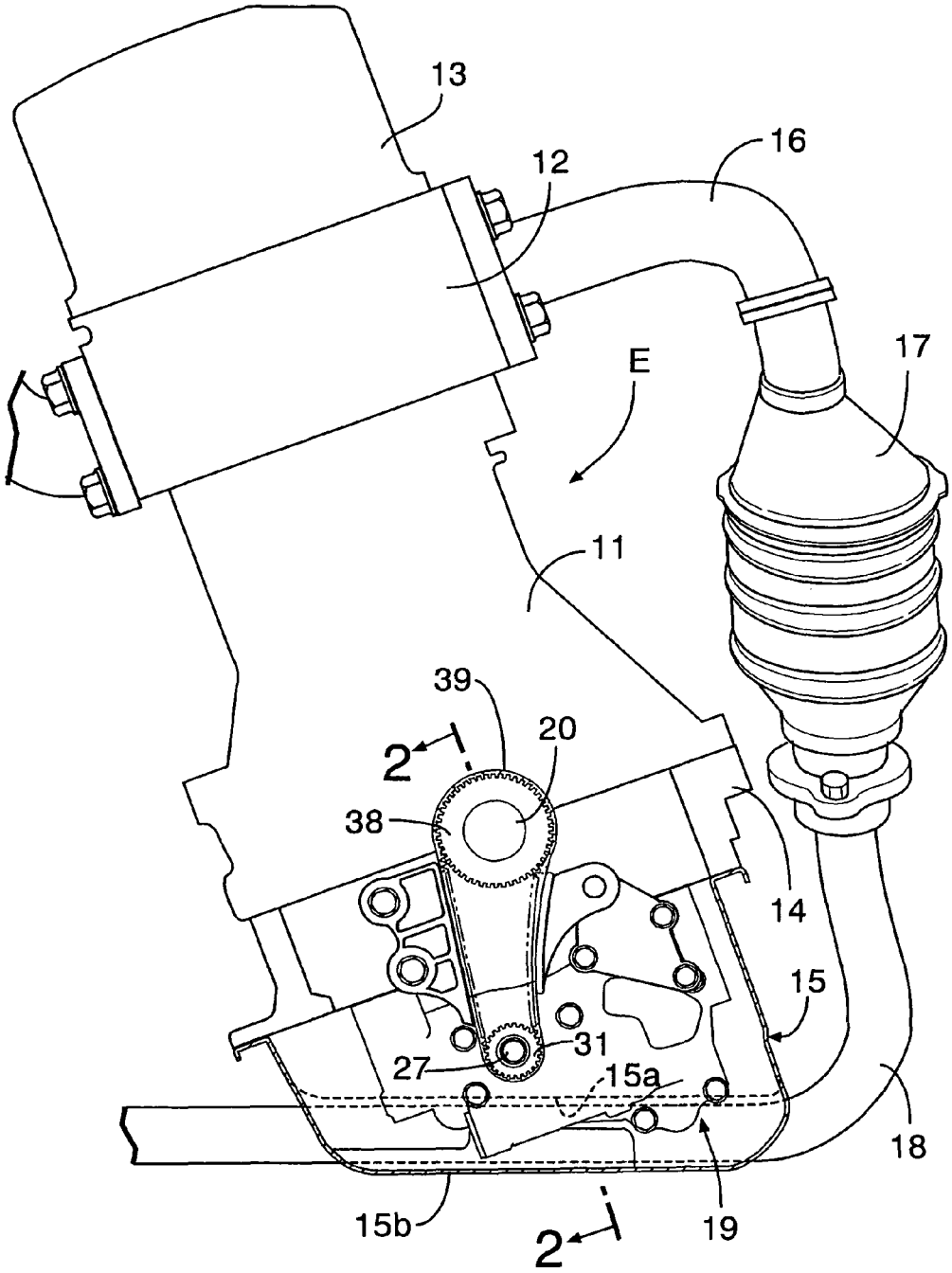
FIG. 1 is a side view of an in-line 4 cylinder diesel engine related to a first embodiment (first embodiment).

11 Cylinder block
15 Oil pan
15*a* Shallow bottom part
15*b* Deep bottom part
18 Exhaust pipe (exhaust gas passage)
21 Balancer housing
27 Driven balancer shaft (balancer shaft)
28 Follower balancer shaft (balancer shaft)
47 Oil level sensor (oil sensor)
54 Cover member
54*b* Breather hole
55 Sensing element
56 Shielding part
56*a* Air vent hole

BEST MODE FOR CARRYING OUT THE INVENTION

Modes for carrying out the present invention are explained below by reference to drawings.

Embodiment 1

FIG. 1 to FIG. 8 show a first embodiment of the present invention.

As is clear from FIG. 1, a diesel engine E transversely mounted in an engine compartment of an automobile has a cylinder block 11, a cylinder head 12 and head cover 13 joined to an upper part thereof, and a crankcase 14 and oil pan 15 joined to a lower part thereof. An exhaust pipe 18 connected via a DPF (Diesel Particulate Filter) 17 to an exhaust manifold 16 joined to a front face of the cylinder head 12 extends to the rear of a vehicle body via a lower face of the oil pan 15. A secondary balancer system 19 that reduces secondary vibration of the engine E is provided between the lower face of the cylinder block 11 and the oil pan 15. A crankshaft 20 is rotatably supported on mating faces of the cylinder block 11 and the crankcase 14.

The structure of the secondary balancer system 19 is now explained by reference to FIG. 2 to FIG. 6.

A balancer housing 21 of the secondary balancer system 19 is formed by joining an upper housing 22 and a lower housing 23 via a plurality of bolts 24, and further joining a side housing 25 to a right side face of the lower housing 23 via a plurality of bolts 26, and a driven balancer shaft 27 and a follower balancer shaft 28 are supported therewithin in parallel to the crankshaft 20. The balancer housing 21 is fixed to a lower face of the crankcase 14 via two bolts 29 and 29 running through the upper housing 22 and the lower housing 23 from bottom to top and two bolts 30 and 30 running through the side housing 25 from bottom to top. Openings 61 and 62 are formed in an upper face of the upper housing 22, an opening 63 is formed in mating faces of the upper housing 22 and the lower housing 23, and an opening 64 is formed between the upper housing 22 and the side housing 25. The interior of the balancer housing 21 communicates with the interior of the oil pan 15 via these openings 61, 62, 63, and 64.

Provided on the driven balancer shaft 27 positioned on the rear side of the vehicle body are, going from one end to the other end, a driven sprocket 31, a driven gear 32, a first balancer weight 33, and a second balancer weight 34. Provided on the follower balancer shaft 28 positioned on the front side of the vehicle body are, going from one end to the other end, a follower gear 35, a first balancer weight 36, and a second balancer weight 37.

An endless chain 39 (see FIG. 1 and FIG. 2) is wrapped around a drive sprocket 38 (see FIG. 1) provided on the crankshaft 20 and the driven sprocket 31 provided on the driven balancer shaft 27. The driven gear 32 provided on the driven balancer shaft 27 meshes with the follower gear 35 provided on the follower balancer shaft 28.

Rotation of the crankshaft 20 due to the engine E running is transmitted to the driven balancer shaft 27 via the drive sprocket 38, the endless chain 39, and the driven sprocket 31, and rotation of the driven balancer shaft 27 is transmitted to the follower balancer shaft 28 via the driven gear 32 and the follower gear 35. Since the number of teeth of the drive sprocket 38 of the crankshaft 20 is set at twice the number of teeth of the driven sprocket 31 of the driven balancer shaft 28, and the number of teeth of the driven gear 32 is set equal to the number of teeth of the follower gear 35, the driven balancer shaft 27 and the follower balancer shaft 28 rotate in directions opposite to each other at a rotational speed twice the rotational speed of the crankshaft 20, and secondary vibration of the engine E is suppressed by the first and second balancer weights 33, 36; 34, 37 provided on the driven balancer shaft 27 and the follower balancer shaft 28.

A trochoidal type oil pump 43 having an inner rotor 42 meshing with an outer rotor 41 is housed in a recess 40 formed in a mating face of the lower housing 23 via which it is joined to the side housing 25. A pump shaft 44 fixed to the inner rotor 42 is joined to the follower balancer shaft 28 placed coaxially therewith via a coupling 45. A filter 46 for filtering oil taken into the oil pump 43 is housed in a bottom part of the lower housing 23.

Figure 2:
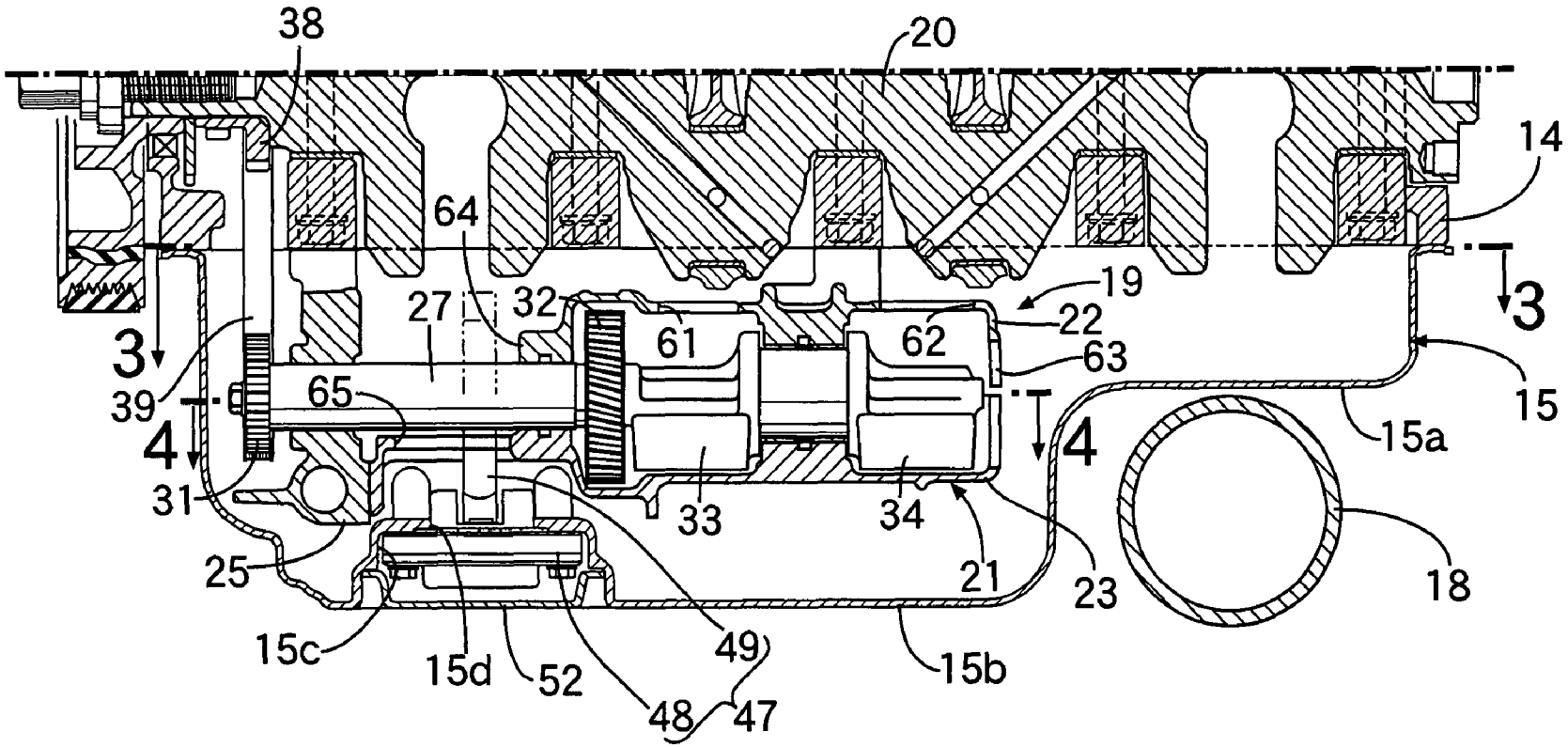
FIG. 2 is a sectional view along line 2-2 in FIG. 1 (first embodiment).

As is clear from FIG. 2, with regard to the oil pan 15, a bottom part on the vehicle body left-hand side (right-hand side in the figure) is a shallow bottom part 15*a* that is stepped shallower, and the remaining part is a deep bottom part 15*b* that is deeper than the shallow bottom part 15*a*. The shallow bottom part 15*a* is provided at a position where it does not interfere with the secondary balancer system 19, and the exhaust pipe 18 is placed by utilizing a space formed beneath the shallow bottom part 15*a*.

Figure 7:
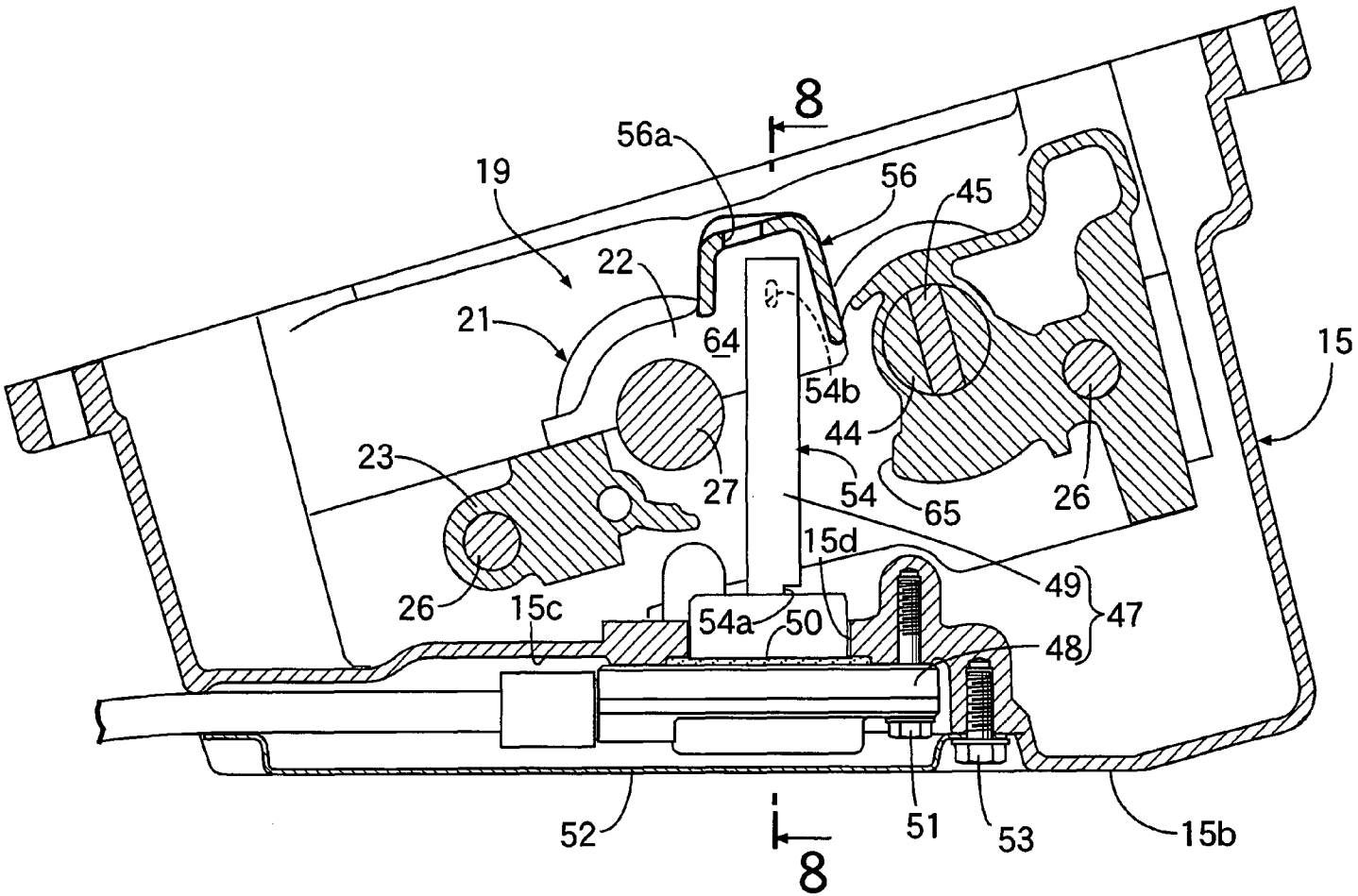
FIG. 7 is a sectional view along line 7-7 in FIG. 3 (first embodiment).
Figure 8:
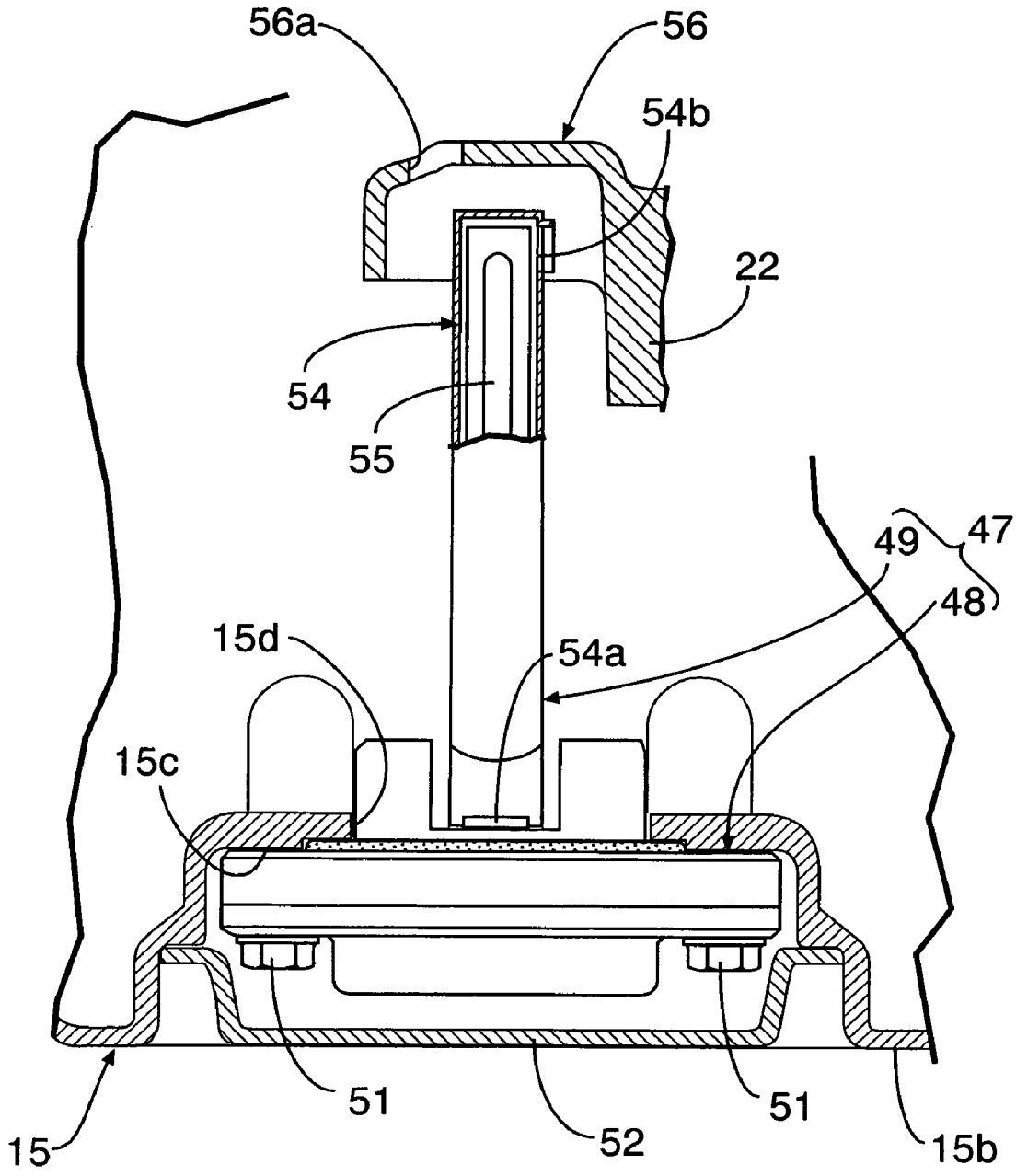
FIG. 8 is a sectional view along line 8-8 in FIG. 7 (first embodiment).

As is clear from FIG. 2, FIG. 7, and FIG. 8, an oil level sensor 47 for detecting the oil level within the oil pan 15 includes a plate-shaped mounting part 48 and a tower-shaped sensing part 49 extending upward from the center of the mounting part 48. An opening 15*d* is formed in the center of a recess 15*c* formed by recessing upward the deep bottom part 15*b* of the oil pan 15, and with regard to the oil level sensor 47, in a state in which the sensing part 49 is inserted into the oil pan 15 via the opening 15*d*, the mounting part 48 is fixed to the recess 15*c* around the opening 15*d* via a seal member 50 by means of three bolts 51. In order to protect the mounting part 48 of the oil level sensor 47, a plate-shaped cover member 52 is fixed to the recess 15*c* of the oil pan 15 via a plurality of bolts 53.

The sensing part 49 of the oil level sensor 47 includes a hollow cover member 54; a transversely long slit-shaped oil hole 54*a* communicating with engine oil within the oil pan 15 is formed at the lower end of the cover member 54, and a breather hole 54*b* communicating with air within the balancer housing 21 is formed at the upper end of the cover member 54. Therefore, the oil level within the cover member 54 of the sensing part 49 moves up and down so as to coincide with the oil level within the balancer housing 21 (that is, the oil level within the oil pan 15).

A plate-shaped sensing element 55 is placed in the interior of the cover member 54 of the sensing part 49 of the oil level sensor 47. After the sensing element 55 is heated to a temperature that is higher than the oil temperature by, for example, 10° C. by passing current through the sensing element 55 so as to generate heat, the time taken for the temperature to decrease by, for example, 5° C. is measured. When the oil level is high, heat radiation from the sensing element 55 to the engine oil is promoted and the temperature decreases quickly, whereas when the oil level is low, heat radiation from the sensing element 55 to the engine oil is suppressed and the temperature decreases slowly, thus enabling the oil level within the oil pan 15 to be detected.

The upper housing 22 and the side housing 25 are not in intimate contact with each other but are spaced from each other, and in that portion the balancer housing 21 opens widely via the opening 64. An opening 65 is formed in the lower housing 23 positioned beneath the opening 64, the sensing part 49 of the oil level sensor 47 passes through the opening 65 of the lower housing 23 from bottom to top, and projects between the driven balancer shaft 27 and the follower balancer shaft 28 within the balancer housing 21.

The shielding part 56 projects from the upper housing 22 toward the opening 64 of the balancer housing 21. The shielding part 56 is an inverted cup-shaped member having its lower face open, and the shielding part 56 covers an upper end part of the sensing part 49 of the oil level sensor 47. An air vent hole 56*a* is formed in an upper face of the shielding part 56 at a position higher than the breather hole 54*b* of the sensing part 49 of the oil level sensor 47.

The operation of the embodiment of the present invention having the above-mentioned arrangement is now explained.

When the oil level varies due to agitation of engine oil within the oil pan 15 due to shaking, acceleration/deceleration, turning, etc. of the vehicle body, the detection precision of the oil level sensor 47 deteriorates, but in the interior of the balancer housing 21, in particular a space between the driven balancer shaft 27 and the follower balancer shaft 28 supported on the interior of the balancer housing 21, variation of the oil level is smoothed and becomes small. Therefore, placing the sensing part 49 of the oil level sensor 47 in the space between the driven balancer shaft 27 and the follower balancer shaft 28 within the balancer housing 21 enables variation of the oil level to be minimized and the detection precision to be enhanced without providing a special baffle plate.

Furthermore, forming the shallow bottom part 15*a* in the oil pan 15 for placing the exhaust pipe 18 makes it difficult to ensure a space for placing the oil level sensor 47 within the oil pan 15, but this problem can be solved by placing the oil level sensor 47 by utilizing a space within the balancer housing 21 placed in the deep bottom part 15*b* of the oil pan 15.

Figure 3:
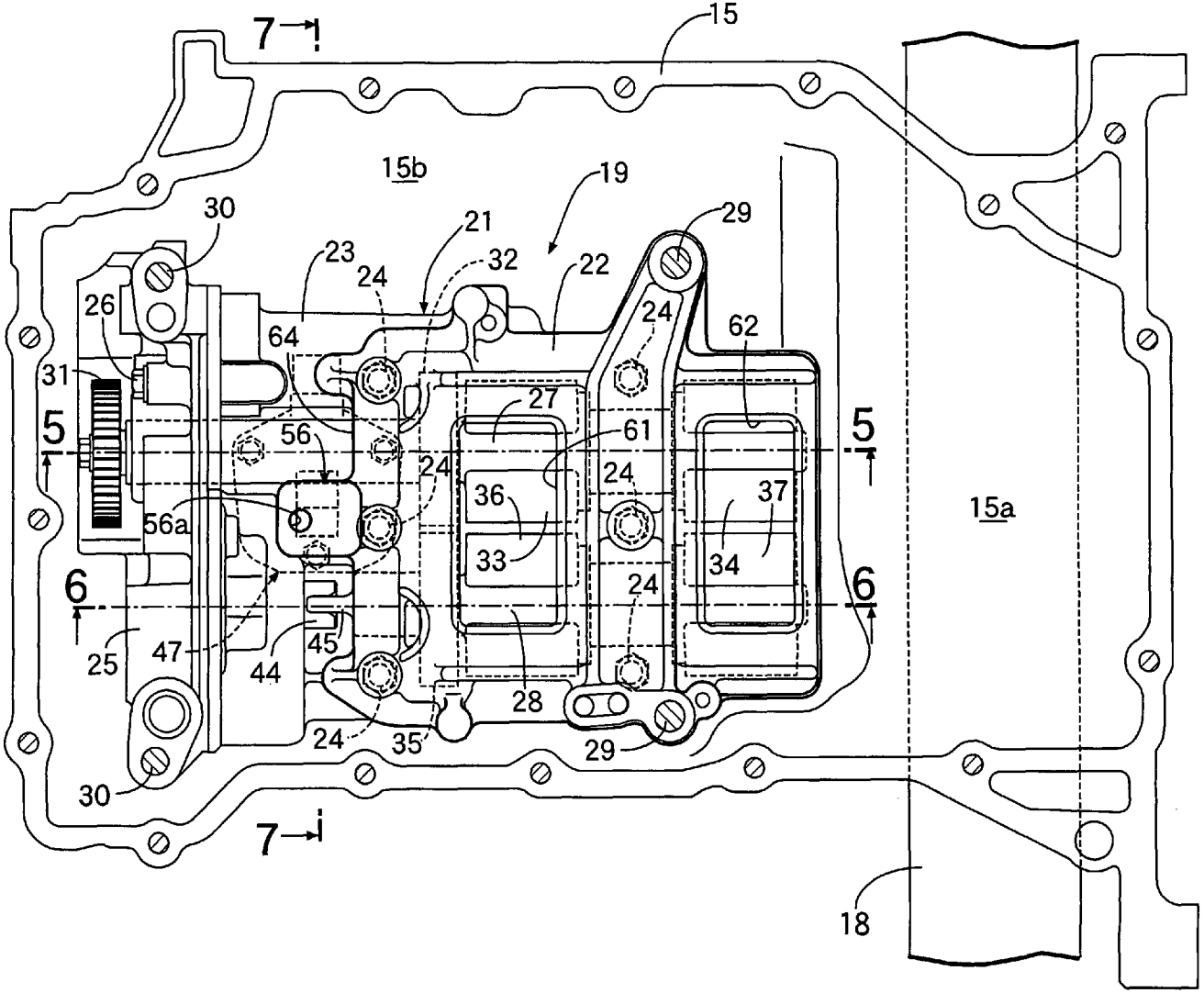
FIG. 3 is a view from arrowed line 3-3 in FIG. 2 (first embodiment).
Figure 4:
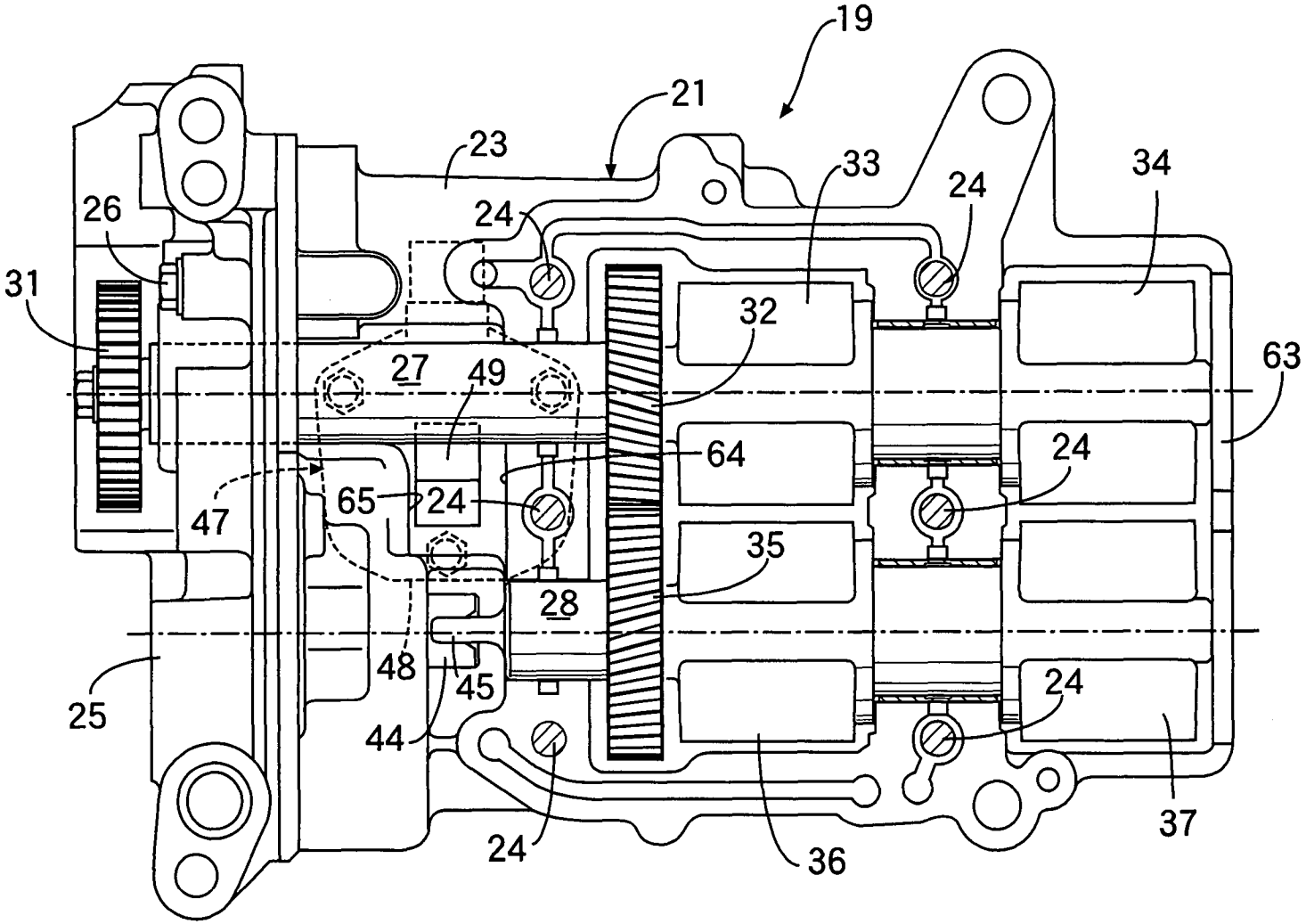
FIG. 4 is a view from arrowed line 4-4 in FIG. 2 (first embodiment).
Figure 5:
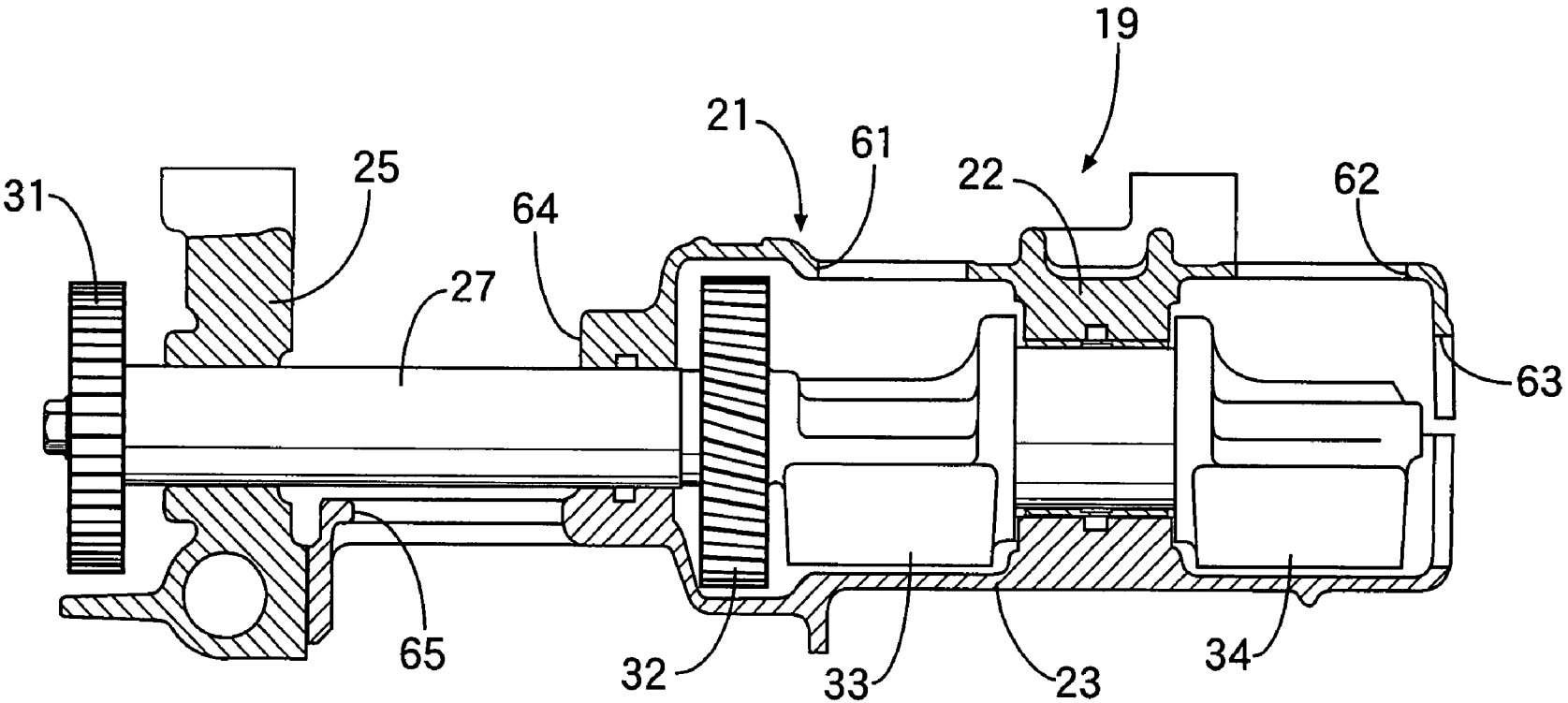
FIG. 5 is a sectional view along line 5-5 in FIG. 3 (first embodiment).
Figure 6:
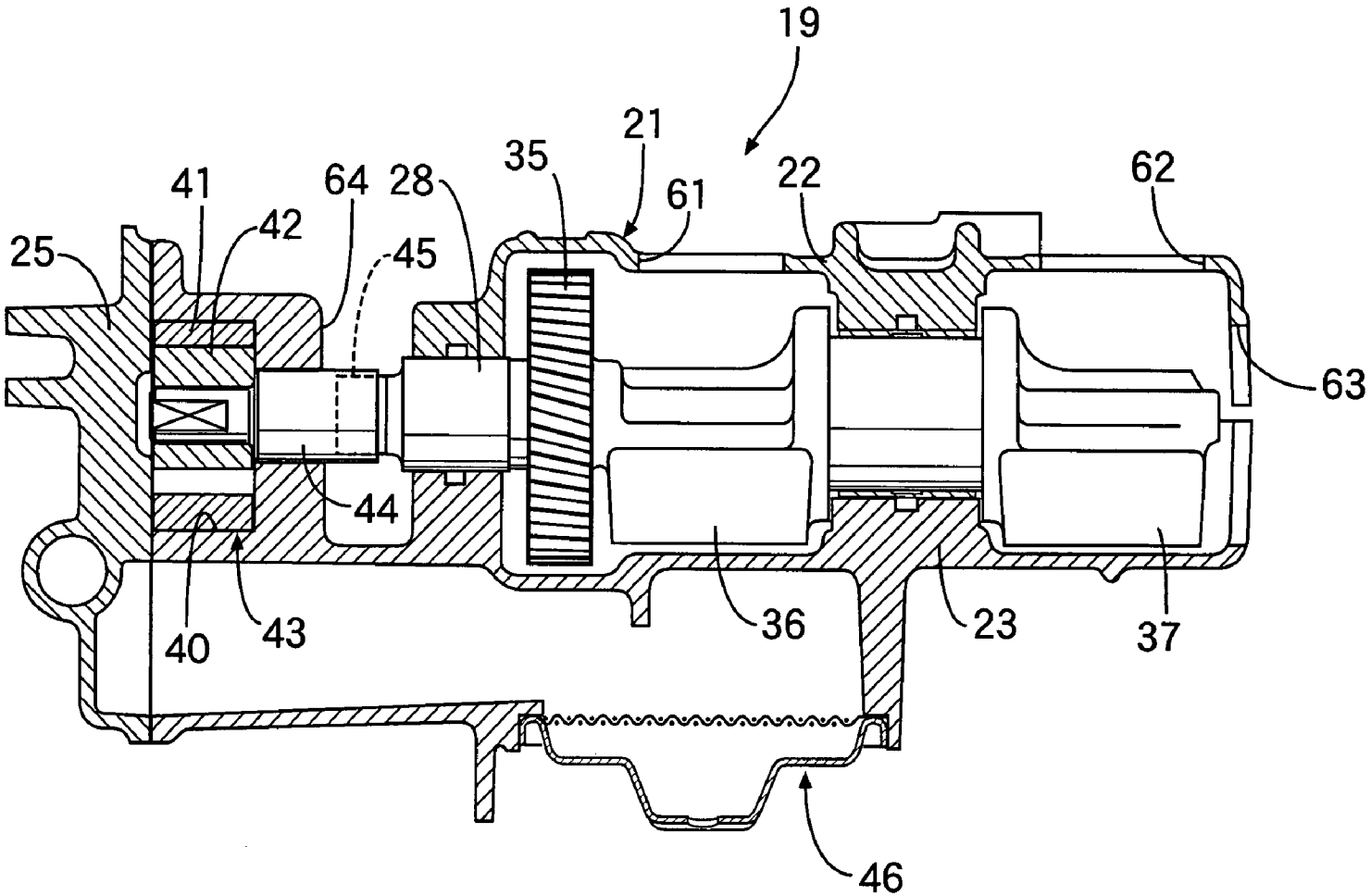
FIG. 6 is a sectional view along line 6-6 in FIG. 3 (first embodiment).

As is clear from FIG. 3, the exhaust pipe 18 and the oil level sensor 47 are placed so as not to overlap each other in plan view. This placement ensures that there is a distance between the high temperature exhaust pipe 18 and the oil level sensor 47, which is susceptible to heat, thus preventing the detection precision of the oil level sensor 47 from deteriorating due to heat.

Moreover, when engine oil splashes enter into the breather hole 54*b* of the cover member 54 of the oil level sensor 47, the detection precision is affected, but since the breather hole 54*b* is covered by the shielding part 56, it is possible to prevent splashes entering from the breather hole 54*b*. In this case, since the shielding part 56 is integrated with the upper housing 22 of the balancer housing 21, the number of components can be reduced compared with a case in which the shielding part 56 is formed from an independent component.

Furthermore, when an opening part at the lower end of the shielding part 56 is submerged under the liquid surface of engine oil, if air is sealed within the shielding part 56, the pressure of the internal space varies in response to variation in the oil level. As a result, the inner pressure of the cover member 54 communicating with the internal space via the breather hole 54*b* also changes, the liquid level of engine oil within the cover member 54 also varies, and the detection precision of the oil level sensor 47 deteriorates.

However, in accordance with the present embodiment, since the air vent hole 56*a* is formed in the upper face of the shielding part 56, it is possible by means of the air vent hole 56*a* to prevent air from being sealed in the internal space and to avoid any degradation in the detection precision of the oil level sensor 47. Furthermore, since the air vent hole 56*a* opens vertically and the breather hole 54*b* opens horizontally, it is possible to suppress the possibility of engine oil splashing through both the air vent hole 56*a* and the breather hole 54*b* and entering the cover member 54.

In this embodiment the air vent hole 56*a* of the shielding part 56 is provided at a position higher than the breather hole 54*b* of the sensing part 49, but as long as it is a position that does not face the opening direction of the breather hole 54*b* (preferably a position displaced by 180°), the same effects can be obtained by providing the air vent hole 56*a* at a position lower than the breather hole 54*b*. Due to this layout, the degree of freedom in the position at which the air vent hole 56*a* is provided increases, it becomes possible to open the air vent hole 56*a* horizontally, and it is possible to prevent any degradation in the detection precision of the oil level sensor 47 due to oil scattering within the oil pan 15 or oil dripping from above.

Embodiment 2

Figure 9:
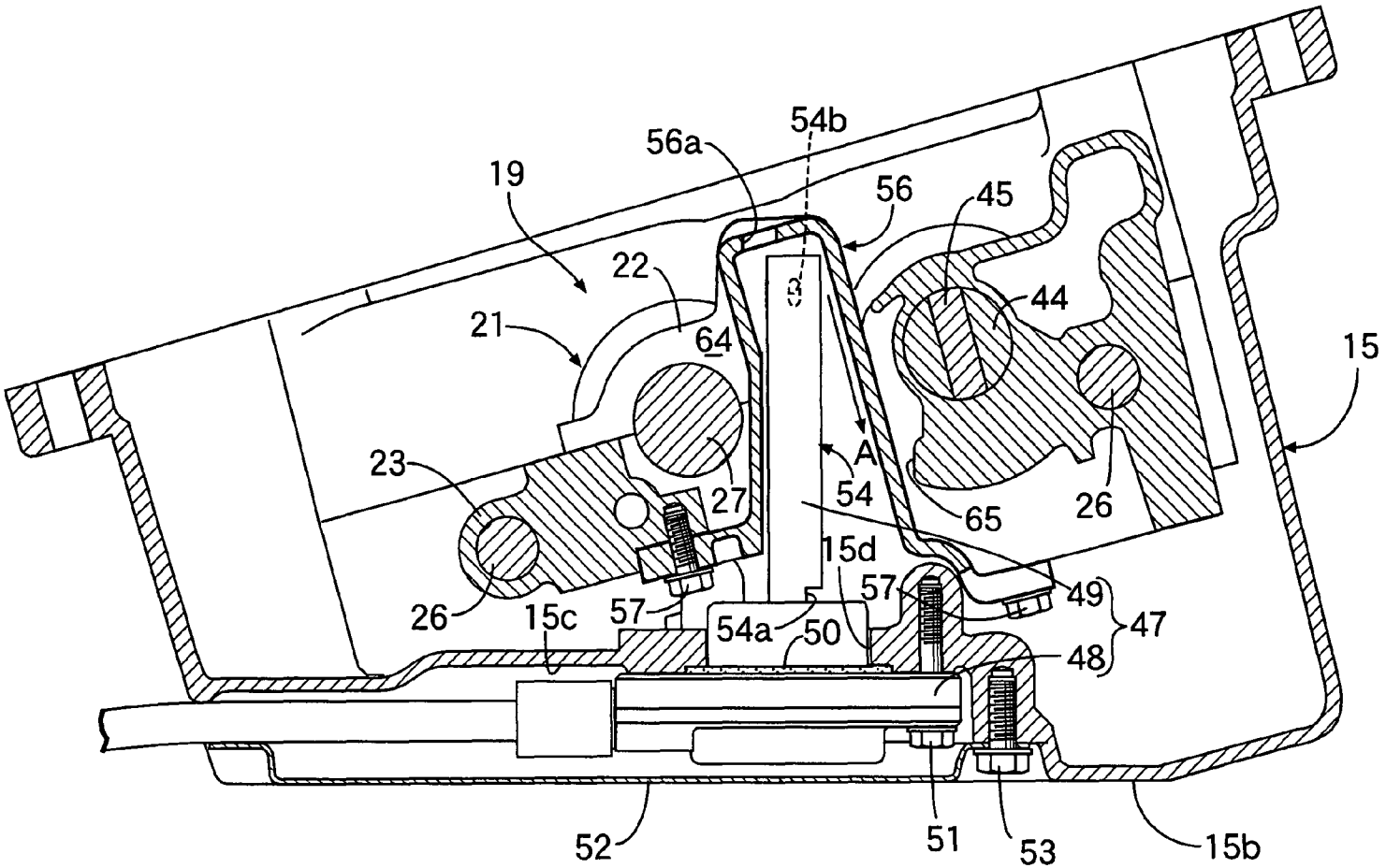
FIG. 9 is a view, corresponding to FIG. 7, related to a second embodiment (second embodiment).

A second embodiment of the present invention is explained by reference to FIG. 9.

In the first embodiment, the shielding part 56 is formed integrally with the upper housing 22, but a shielding part 56 of the second embodiment is formed as an independent member, and is mounted on a lower face of an opening 65 of a lower housing 23 of a balancer housing 21 via bolts 57 and 57. The shielding part 56 is a tapered tubular member tapering from a lower part to an upper part, and covers substantially the whole of a sensing part 49 of an oil level sensor 47 projecting into an oil pan 15.

In this way, covering substantially the whole of the sensing part 49 with the shielding part 56 enables the influence of the splashing of engine oil to be further reliably eliminated, and the detection precision of the oil level sensor 47 to be yet further enhanced. Furthermore, when the oil pan 15 is detached from the crankcase 14 in the direction of arrow A, since the shielding part 56 mounted on the balancer housing 21 has a downwardly widening shape, it is possible to prevent the upper end of the oil level sensor 47 mounted on the oil pan 15 from interfering with the inner face of the shielding part 56.

The arrangement and effects of the second embodiment are otherwise the same as the above-mentioned arrangement and effects of the first embodiment.

Embodiments of the present invention are described in detail above, but the present invention may be modified in a variety of ways as long as the modifications do not depart from the spirit and scope thereof.

For example, in the embodiment the oil level sensor 47 for detecting the level of engine oil is explained, but the present invention may be applied to any other oil sensor for detecting the temperature or the degree of deterioration of engine oil.

Furthermore, in the second embodiment, the shielding part 56 covers substantially the whole of the sensing part 49 of the oil level sensor 47, but an operational effect comparable to that of the case where the whole is covered can be obtained by covering at least the upper half of the sensing part 49.

The invention claimed is:

1. An oil sensor placement structure in an engine, the engine comprising a balancer housing for housing a mutually parallel pair of balancer shafts between a lower face of a cylinder block and an oil pan storing engine oil, the structure being characterized in that an oil sensor provided in a bottom part of the oil pan so as to stand vertically upright is placed between the pair of balancer shafts.

2. An oil sensor placement structure in an engine, the engine comprising a balancer housing for housing a mutually parallel pair of balancer shafts between a lower face of a cylinder block and an oil pan storing engine oil, the structure being characterized in that an oil sensor provided in a bottom part of the oil pan so as to stand vertically upright is placed so as to project into the interior of the balancer housing.

3. The oil sensor placement structure in an engine according to claim 1 or claim 2, wherein an exhaust gas passage through which exhaust gas flows is placed beneath the oil pan, and the oil sensor is placed at a position where the oil sensor does not overlap with the exhaust gas passage when viewed vertically.

4. The oil sensor placement structure in an engine according to claim 1 or claim 2, wherein the bottom part of the oil pan comprises a shallow bottom part and a deep bottom part having different depths, an exhaust gas passage through which exhaust gas flows is placed beneath the shallow bottom part, and the oil sensor is placed above the deep bottom part.

5. The oil sensor placement structure in an engine according to any one of claim 1 or claim 2, wherein the oil sensor comprises a cover member covering a sensing element, and a breather hole formed in the vicinity of the upper end of the cover member is covered by a shielding part provided on the balancer housing.

6. The oil sensor placement structure in an engine according to claim 5, wherein the shielding part surrounds at least an upper half of a portion of the oil sensor exposed within the oil pan.

7. The oil sensor placement structure in an engine according to claim 5, wherein the shielding part is formed as a separate body from the balancer housing and is mounted on the balancer housing.

8. The oil sensor placement structure in an engine according to claim 5, wherein an air vent hole providing communication between the interior and exterior of the shielding part is formed at a position of the shielding part that is higher than the breather hole.

9. The oil sensor placement structure in an engine according to claim 5, wherein an air vent hole providing communication between the interior and exterior of the shielding part is formed at a position of the shielding part that does not face the opening direction of the breather hole.

* * * * *